US008459836B2

(12) United States Patent
Chang

(10) Patent No.: US 8,459,836 B2
(45) Date of Patent: Jun. 11, 2013

(54) ILLUMINATION DEVICE HAVING CHANGEABLE ILLUMINATION AREA

(75) Inventor: Kuo-Cheng Chang, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 64 days.

(21) Appl. No.: 13/297,151

(22) Filed: Nov. 15, 2011

(65) Prior Publication Data

US 2012/0140473 A1 Jun. 7, 2012

(30) Foreign Application Priority Data

Dec. 6, 2010 (TW) ..... 99142280 A

(51) Int. Cl.
*F21V 21/14* (2006.01)

(52) U.S. Cl.
USPC ..... 362/249.03; 362/249.02; 362/249.1; 361/679.09

(58) Field of Classification Search
CPC ..... B60K 35/00; G11B 33/025; H05K 5/0226
USPC .. 361/679.27, 679.09; 345/903; 362/249.02, 362/249.03
See application file for complete search history.

(56) References Cited

U.S. PATENT DOCUMENTS 8,310,819 B2 * 11/2012 Shen ..... 361/679.01
2009/0168422 A1 * 7/2009 Chiu et al. ..... 362/249.03

* cited by examiner

*Primary Examiner* — Tracie Y Green
(74) *Attorney, Agent, or Firm* — Altis Law Group, Inc.

(57) ABSTRACT

An illumination device includes a first lighting element, a second lighting element and a pivoting shaft. The first lighting element includes a first lighting module and a first power module contacted with one side of the first lighting module for providing power to the first lighting module. The second lighting element includes a second lighting module and a second power module contacted with one side of the second lighting module for providing power to the second lighting module. The pivoting shaft includes a first stick and a second stick detachable engaging with the first stick. The first stick is rotatably connected to the first power module. The second stick is rotatably connected to the second power module.

14 Claims, 4 Drawing Sheets

ILLUMINATION DEVICE HAVING CHANGEABLE ILLUMINATION AREA

BACKGROUND

1. Technical Field

The present disclosure generally relates to illumination devices, and particularly to an illumination device with changeable illumination area.

2. Description of the Related Art

Light emitting diodes (LEDs) have many advantages, such as high luminosity, low operational voltage, low power consumption, compatibility with integrated circuits, easy driving, long term reliability, and environmental friendliness; thus, LEDs have been widely promoted as a light source.

However, the conventional LED illumination devices have limited brightness and illumination area. It can not satisfy illumination demand in certain areas, such as stadiums and stages, where a large-area illumination is needed. Typically, in order to increase the illumination area, the volume of the illumination devices generally increases to receive a number of LED light sources and corresponding components therein. The large volumes of the illumination devices cause an increase in difficulty of conveying the illumination devices.

What is needed, therefore, is an illumination device which can overcome the above-mentioned problems.

BRIEF DESCRIPTION OF THE DRAWINGS

Many aspects of the present illumination devices can be better understood with reference to the following drawings. The components in the drawings are not necessarily drawn to scale, the emphasis instead being placed upon clearly illustrating the principles of the present illumination devices. Moreover, in the drawing, like reference numerals designate corresponding parts throughout the several views.

DETAILED DESCRIPTION

Embodiments of an illumination device 100 are described in detail here with reference to the drawings.

Figure 1:
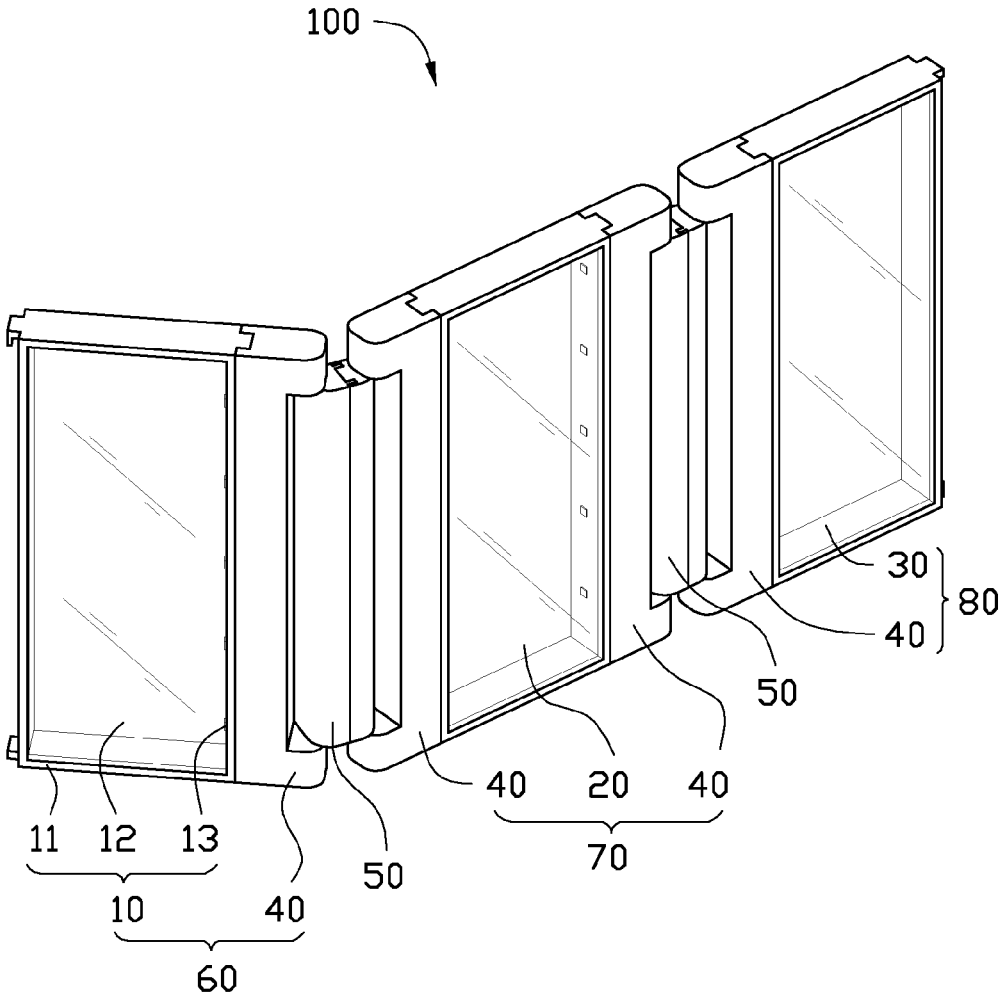
FIG. 1 is an isometric view of an illumination device in accordance with an embodiment, wherein the illumination device is unfolded.

Referring to FIG. 1, an illumination device 100 in accordance with an embodiment includes a plurality of lighting elements 60, 70, 80 and a plurality of pivoting shafts 50 connecting the lighting elements 60, 70, 80 together. In this embodiment, there light elements, i.e., a first lighting element 60, a second lighting element 70, a third lighting element 80, are shown, and two pivoting shafts 50 are provided for connecting the first, the second, the third lighting elements 60, 70, 80.

The first lighting element 60 includes a first lighting module 10, and a power module 40 located at one side of the first lighting module 10 for providing power to the first lighting module 10.

The first lighting module 10 includes an enclosure 11, a light pervious plate 12, and a number of light emitting diodes 13.

Figure 2:
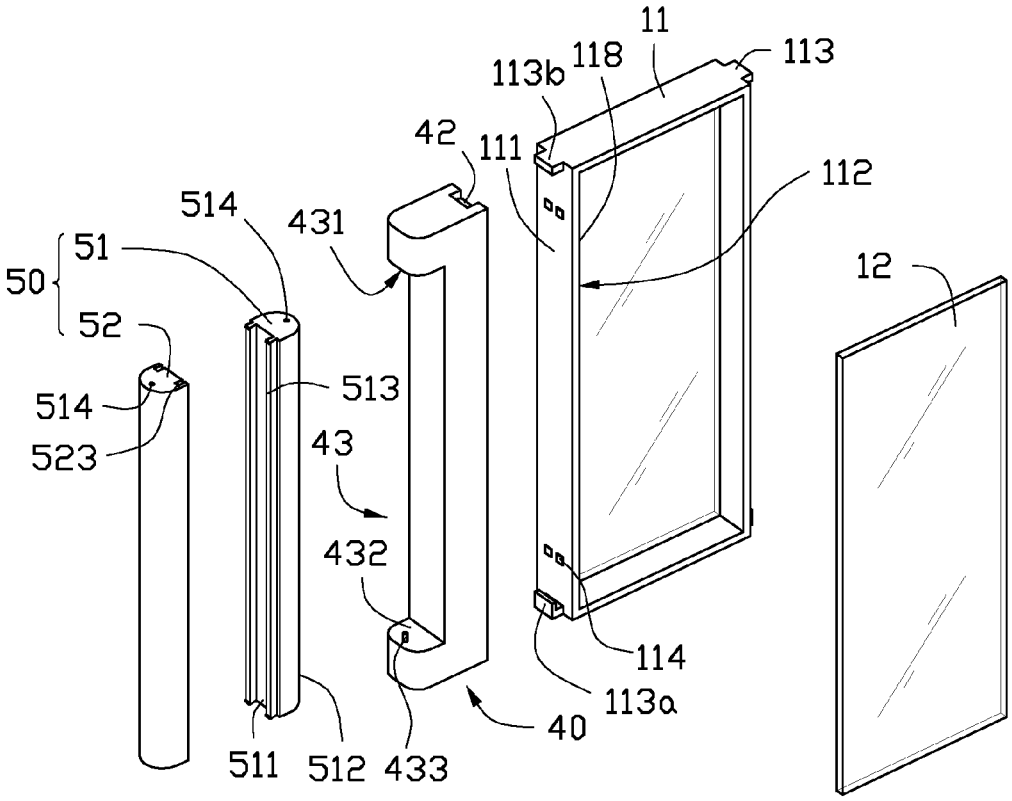
FIG. 2 is a schematic, exploded view of a lighting element and a pivoting shaft of the illumination device of FIG. 1.
Figure 3:
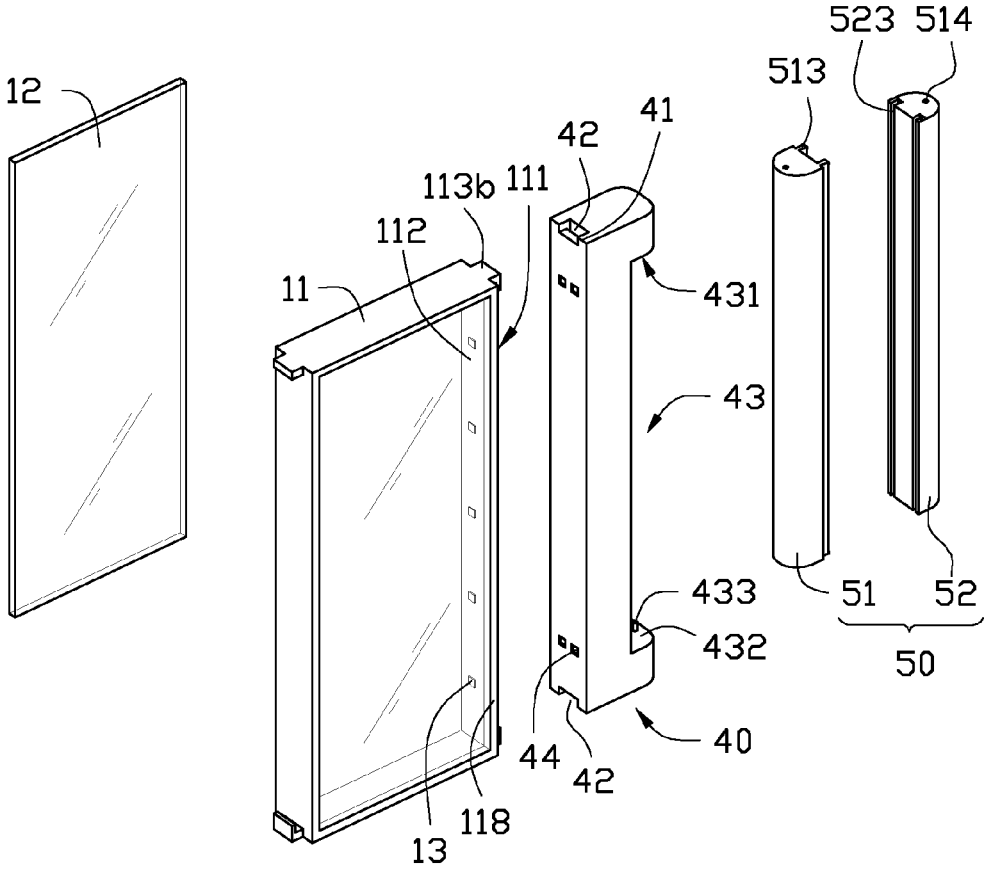
FIG. 3 is an isometric reverse view of the lighting element and the pivoting shaft of FIG. 2.

Referring to FIGS. 2 and 3 also, the enclosure 11 is substantially rectangular in shape. A clasp 113 is formed on each of four corners of the enclosure 11 and extends outwardly from an outer periphery of the enclosure 11. The clasp 113 may be a hook 113*a* or a square protrusion 113*b*, a width of the clasp 113 is smaller than a thickness of the enclosure 11. In present embodiment, the hooks 113*a* are formed on corners at a bottom of the enclosure 11 and the square protrusions 113*b* are formed on corners at a top of the enclosure 11. In addition, the clasp 113 may have other construction to meet demands of practical application. The enclosure 11 comprises two opposite side walls 118. On an outer surface 111 of one side wall 118 of the enclosure 11 contacting the power module 40, there is one protrusion 113*b* at a top end and one hook 113*a* at a bottom end thereof. The protrusion 113*b* and the hook 113*a* both extend beyond the sidewall 118 to the power module 40. A number of metal sheets 114 are formed on the outer surface 111 of the side wall 118. It can be understood, that the enclosure 11 is rectangular is a matter of design, and the enclosure 11 can be polygonal according to the demands of practical application. The enclosure 11 may be made of transparent materials, such as resin or glass.

The light pervious plate 12 is positioned onto the enclosure 11 to envelop the enclosure 11. The light pervious plates 12 may be made of resin, glass, or other light pervious materials.

The light emitting diodes 13 are placed in the enclosure 11 and located on an inner surface 112 of the side wall 118 which contacts the power module 40. The light emitting diodes 13 is in line at the inner surface 112. The light emitting diodes 13 are electrically connected with each other in series or in parallel. Two periphery light emitting diodes 13 of the line are respectively electrically connected to the metal sheets 114 placed on the outer surface 111 of the side wall 118. It can be understood that the light emitting diodes 13 may be placed on the inner surfaces 112 of any side wall of the enclosure 11 in any pattern to meet the demand of light intensity or optical uniformity.

The power module 40 is elongated and substantially rectangular in shape. One side of the power module 40 that closes to the outer surface 111 of the side wall 118 of the enclosure 11 defines two groove 42 respectively corresponding to the hook 113*a* and the square protrusion 113*b* of the enclosure 11, and forms many metal protrusions 44 matched to the metal sheets 114 of the side wall 118 of the enclosure 11. The hook 113*a* and the square protrusion 113*b* of the enclosure 11 are engaged in the grooves 42 of the power module 40 to fix the power module 40 onto the enclosure 11. The light emitting diodes 13 located in the enclosure 11 can be electrically connected to the corresponding power module 40 by the contact of the metal protrusions 44 of the power module 40 and the metal sheets 114 of the side wall 118 of the enclosure 11. The other side of the power module 40 that away from the outer surface 111 of the side wall 118 of the enclosure 11 defines an elongated recess 43 for receiving one pivoting shaft 50. The elongated recess 43 has a top end 431 and a bottom end 432, and the top end 431 and the bottom end 432 each have a projection 433 formed thereon. The projections 433 formed in the elongated recess 43 are coaxial with each other.

The second lighting element 70 includes a second lighting module 20 and two power modules 40 respectively located at opposite sides of the second lighting module 20. The second lighting module 20 is similar to the first light element 10, except that the metal sheets are respectively placed on the two opposite side walls of the enclosure, and the light emitting diodes are placed on the inner surfaces of the two side walls. At least one of power modules 40 is used for providing power to the second lighting module 20.

The third lighting element 80 is the same as the first lighting element 60, which includes a third lighting module 30 and a power module 40 located at one side of the third lighting module 30 for providing power to the third lighting module 30.

The second lighting element 70 is located between the first lighting element 60 and the third lighting element 80, and is pivotably coupled to the first lighting element 60 and the third lighting element 80 via the pivoting shafts 50. Because the pivoting shafts 50 in the present embodiment are the same, the pivoting shaft 50 joined with the first lighting element 60 and the second lighting element 70 as an example is to be described. The pivoting shaft 50 includes a first elongated stick 51 and an opposite second elongated stick 52 which is detachable engaged with the first elongated stick 51. The first elongated stick 51 is located in the recess 43 of the power module 40 of the first lighting element 60, and the second elongated stick 52 is placed in the recess 43 of the other power module 40 of the second lighting element 70. The first elongated stick 51 and the second elongated stick 52 both have an adequate length so as to be respectively received in the power modules 40 of the first lighting element 60 and the second lighting element 70 simultaneously.

The first elongated stick 51 has a flat side surface 511 and an arc-shaped surface 512. Two elongate strips 513 are formed on the flat side surface 511 of the first elongated stick 51 in parallel. The first elongated stick 51 further defines two holes 514 respectively at two opposite ends thereof corresponding to the projections 433 in the recess 43 of the power module 40 of the first lighting element 60. That is, the projections 433 can be inserted in the holes 514 of the first elongated stick 51, thus the first lighting element 60 is rotatable around the first elongated stick 51 of the pivoting shaft 50 relative to the neighboring second lighting element 70, thereby adjusting the structure of the illumination device 100.

The second elongated stick 52 defines two slots 523 corresponding to the elongate strips 513 of the stick 51. Therefore, the elongate strips 513 of the stick 51 can be slidable and linearly movable relative to the slots 523 to join the second lighting element 70 with the first lighting element 60.

The second elongated stick 52 further defines two holes 514 respectively at two opposite ends thereof to receive the projections 433 in the recess 43 of the power module 40 of the second lighting element 70. That is, the second lighting element 70 is rotatable around the second elongated stick 52 of the pivoting shaft 50 relative to the neighboring first lighting element 60, thereby adjusting the structure of the illumination device 100.

As shown in FIG. 1, the two opposite power modules 40 of the second lighting element 70 are respectively pivotably coupled to the another power modules 40 of the first lighting element 60 and the third lighting element 80 via the pivoting shafts 50. Because the first elongated stick 51 of each pivoting shafts 50 is detachably engaged with the second elongated stick 52 thereof, the second lighting element 70 can be detachably connected with the first lighting element 60 and the third lighting element 80. According to a simulated calculation in advance, the illumination device 100 may includes more than three lighting elements, and each lighting element may include one or two power module 40 for supplying power and connecting with the neighboring lighting element.

Figure 4:
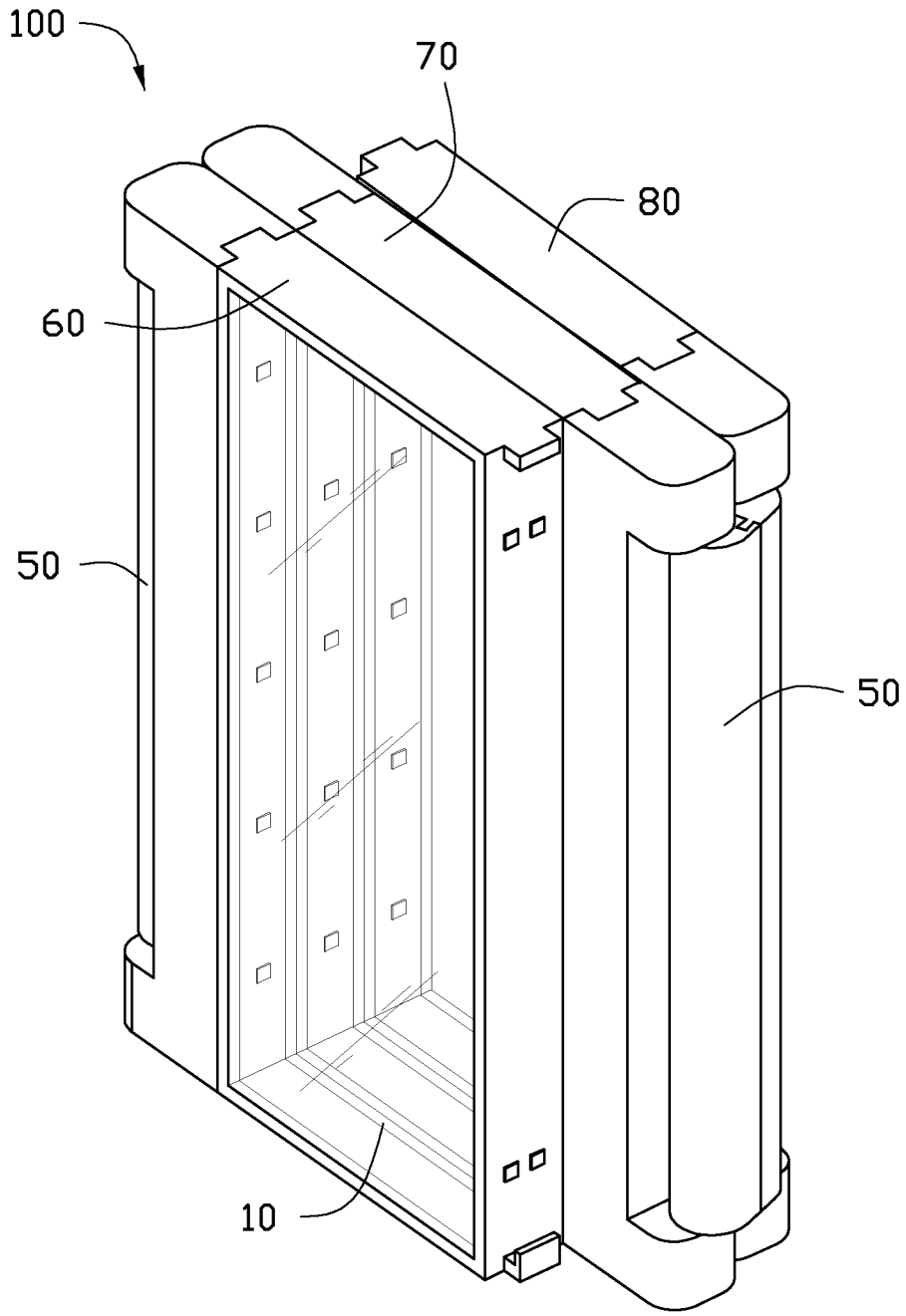
FIG. 4 is an isometric view of the illumination device of FIG. 1 in a folded state.

In addition, the first lighting element 60 is pivotably coupled to the neighboring second lighting element 70 via a pivoting shaft 50, and the first lighting element 60 and the second lighting element 70 are respectively joined with the two separated parts of pivoting shaft 50, the rotating axis (not shown) through the two holes 514 of the first elongated stick 51 is parallel to the rotating axis through the two holes 514 of the second elongated stick 52. Therefore, an included angle between the neighboring lighting elements (such as the first, the second lighting elements 60, 70) is configured to be in the range from above about 0 to about 180 degrees. As shown in FIG. 4, the first, the second, the third lighting elements 60, 70, 80 of the illumination device 100 are folded, that is an included angle between the neighboring lighting elements is equal to 0 degree. Moreover, the lighting elements of the illumination device 100 can be unfolded, that is an included angle between the neighboring lighting elements is equal to 180 degree, as shown in FIG. 1, the second lighting element 70 is parallel to the third lighting element 80. Therefore, the illumination device 100 can be applied in various field, such as indoor illumination (being unfolded to position on the wall; being folded to place on the table), outdoor illumination (being carried by the user).

While certain embodiments have been described and exemplified above, various other embodiments from the foregoing disclosure will be apparent to those skilled in the art. The disclosure is not limited to the particular embodiments described and exemplified but is capable of considerable variation and modification without departure from the scope of the appended claims.

What is claimed is:

1. An illumination device comprising:

a first lighting element, comprising a first lighting module and a first power module contacted with one side of the first lighting module for providing power to the first lighting module;

a second lighting element, comprising a second lighting module and a second power module contacted with one side of the second lighting module for providing power to the second lighting module;

a pivoting shaft comprising a first stick and a second stick detachably engaging with the first stick, the first stick being rotatably connected to the first power module, and the second stick being rotatably connected to the second power module.

2. The illumination device of claim 1, wherein at least one of the first lighting module and the second lighting module comprises an enclosure, a light pervious plate covers the enclosure, and a plurality of light emitting diodes received in the enclosure.

3. The illumination device of claim 2, wherein the enclosure defines a clasp extends outwardly from an outer periphery thereof, one side of the first or the second power module close to the enclosure defines a groove corresponding to the clasp of the enclosure, and the clasp of the enclosure is detachably engaged in the groove of the first or the second power module to fix the first or the second power module onto the enclosure.

4. The illumination device of claim 2, wherein the enclosure has a plurality of metal sheets formed at one side wall thereof, one side of the first or the second power module close to the enclosure forms a plurality of metal protrusions matched to the metal sheets of the enclosure, and the light emitting diodes are electrically connected to the corresponding first or second power module by the contact of the metal protrusions of the first or second power module and the metal sheets of the enclosure.

5. The illumination device of claim 1, wherein the first power module defines a first recess receiving the first stick of the pivoting shaft, a first projection formed in the first recess, the second power module defining a second recess receiving the second stick of the pivoting shaft, a second projection formed in the second recess, the first stick further defining a first hole thereon corresponding to the first projection, the second stick further defining a second hole thereon corresponding to the second projection, the first projection being configured to be embedded in the first hole, and the second projection being configured to be embedded in the second hole.

6. The illumination device of claim 1, wherein the first stick comprises an elongate strip formed thereon, the second stick defines a slot corresponding to the elongate strip of the first stick, and the elongate strip of the first stick is slidable and linearly movable relative to the slot of the second stick to join the first stick with the second stick.

7. The illumination device of claim 6, wherein the strip is truncated-cone-shaped.

8. An illumination device comprising:

a plurality of lighting elements, each lighting element comprising a lighting module and a power module being in contact with one side of the lighting module for providing power to the lighting module;

a plurality of pivoting shafts, each of the pivoting shafts connecting two neighboring light elements together and comprising a first stick and a second stick detachably engaging with the first stick, the first stick and the second stick being respectively rotatably engaged with the two neighboring lighting elements, thereby the two neighboring lighting elements being rotatable relative to each other.

9. The illumination device of claim 8, wherein the lighting module comprises an enclosure, a light pervious plate covered the enclosure, and a plurality of light emitting diodes received in the enclosure.

10. The illumination device of claim 9, wherein the enclosure defines a clasp extending outwardly from an outer periphery thereof, one side of the power module close to the enclosure defines a groove corresponding to the clasp of the enclosure, and the clasp of the enclosure is detachably engaged in the groove of the power module to fix the power module onto the enclosure.

11. The illumination device of claim 9, wherein the enclosure has a plurality of metal sheets located on one side wall thereof, one side of the power module close to the enclosure forms a plurality of metal protrusions matched to the metal sheets of the enclosure, and the light emitting diodes are electrically connected to the power module by the contact of the metal protrusions of the power module and the metal sheets of the enclosure.

12. The illumination device of claim 8, wherein one power module defines a first recess receiving the first stick of the pivoting shaft, a first projection formed in the first recess, a neighboring power module defines a second recess receiving the second stick of the pivoting shaft, a second projection is formed in the second recess, the first stick further defines a first hole thereon to correspond to the first projection, the second stick further defines a second hole thereon to correspond to the second projection, the first projection is configured for embedding in the first hole, and the second projection is configured for embedding the second hole.

13. The illumination device of claim 8, wherein the first stick comprises an elongate strip formed thereon, the second stick defines a slot corresponding to the elongate strip of the first stick, and the elongate strip of the first stick is slidable and linearly movable relative to the slot of the second stick to join the first stick with the second stick.

14. The illumination device of claim 13, wherein the strip is truncated-cone-shaped.

* * * * *